US006805047B2

(12) United States Patent
Wahler

(10) Patent No.: US 6,805,047 B2
(45) Date of Patent: Oct. 19, 2004

(54) GOLF BALL STAMPING DEVICE AND METHOD FOR STAMPING GOLF BALLS

(75) Inventor: Peter Wahler, Köln (DE)

(73) Assignee: Dieter Strüver, Köln (DE)

( * ) Notice: Subject to any disclaimer, the term of this patent is extended or adjusted under 35 U.S.C. 154(b) by 0 days.

(21) Appl. No.: 10/469,333

(22) PCT Filed: Feb. 27, 2002

(86) PCT No.: PCT/EP02/02085

§ 371 (c)(1),
(2), (4) Date: Aug. 27, 2003

(87) PCT Pub. No.: WO02/068204

PCT Pub. Date: Sep. 6, 2002

(65) Prior Publication Data

US 2004/0065219 A1 Apr. 8, 2004

(30) Foreign Application Priority Data

Feb. 27, 2001 (DE) ..... 101 09 445

(51) Int. Cl.[7] ..... B41K 3/02; B41K 3/06; B41F 17/30; B41M 1/40

(52) U.S. Cl. ..... 101/111; 101/DIG. 40; 101/327; 101/405

(58) Field of Search ..... 101/35, 41, 42, 101/103, 109, 111, 327, 333, 405, 406, DIG. 40

(56) References Cited

U.S. PATENT DOCUMENTS

| | | | | | |
|---|---|---|---|---|---|
| 1,422,268 | A | * | 7/1922 | Hupfel | 101/377 |
| 1,814,170 | A | * | 7/1931 | Long | 101/35 |
| 2,561,947 | A | * | 7/1951 | Ellis | 101/41 |
| 2,594,685 | A | | 4/1952 | Russell et al. | |
| 2,616,368 | A | * | 11/1952 | Hochman | 101/333 |
| 4,803,922 | A | | 2/1989 | Dennesen | |
| 5,339,734 | A | | 8/1994 | Mustafa et al. | |
| 5,743,180 | A | * | 4/1998 | Arnke | 101/35 |
| 6,189,451 | B1 | * | 2/2001 | Pichler | 101/333 |

FOREIGN PATENT DOCUMENTS

| | | |
|---|---|---|
| DE | 9418241 | 3/1995 |
| DE | 9418243 | 3/1995 |
| GB | 147521 | 12/1921 |
| WO | 0108892 | 2/2001 |

* cited by examiner

*Primary Examiner*—Leslie J. Evanisko
(74) *Attorney, Agent, or Firm*—Friedrich Kueffner

(57) ABSTRACT

A golf ball stamping device includes a housing with an ink pad, a mechanism for mounting a golf ball in such a way that the golf ball is prevented from turning, and a stamping mechanism for stamping at least one character onto the golf ball, wherein the stamping means includes at least one continuous band and a small wheel for turning the at least one continuous band.

11 Claims, 1 Drawing Sheet

FIG. 3
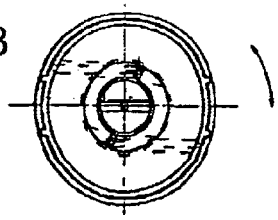
FIG. 1
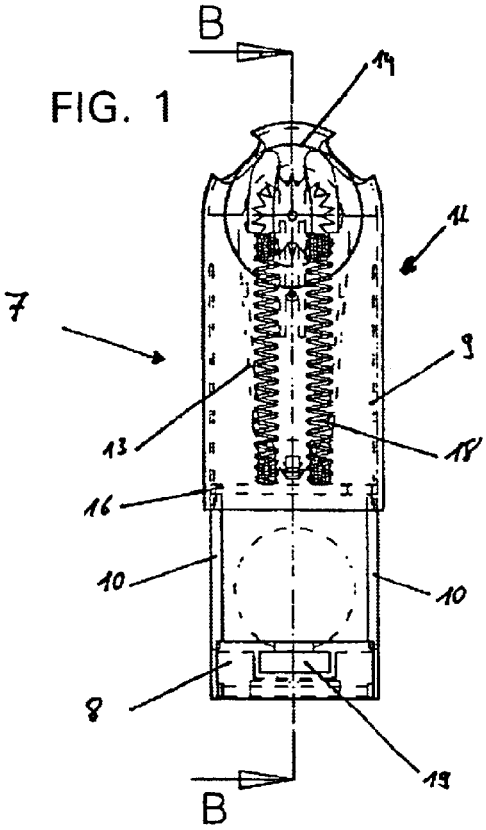
FIG. 2
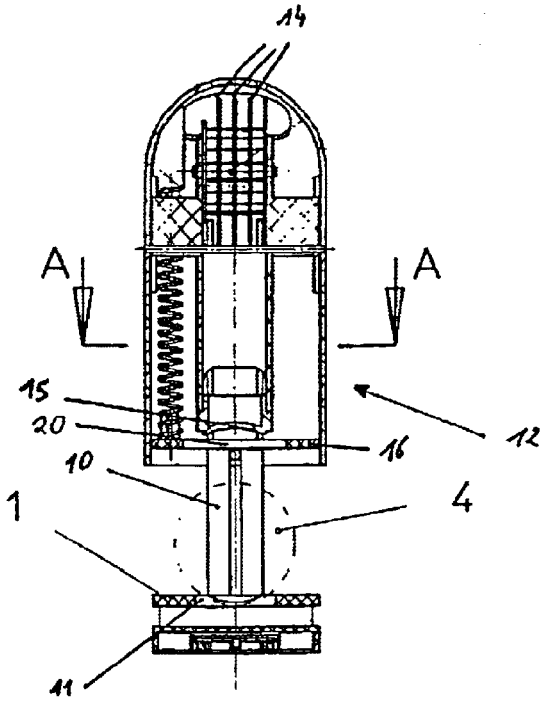
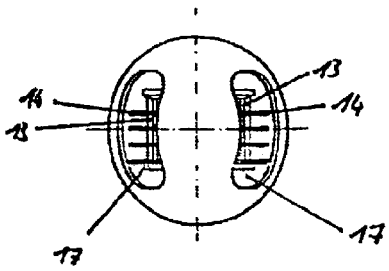
FIG. 4
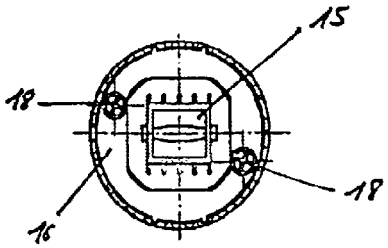
FIG. 5

GOLF BALL STAMPING DEVICE AND METHOD FOR STAMPING GOLF BALLS

This application is a national phase application of PCT application Ser. No. PCT/EP02/02085.

BACKGROUND OF THE INVENTION

1. Field of the Invention

The present invention relates to a golf ball stamping device comprising a housing accommodating an ink pad a means with which a golf ball can be mounted in a manner that prevents it from turning, and a stamping means with which at least one character can be stamped onto the golf ball.

The present invention also relates to a method for stamping golf balls.

2. Description of the Related Art

Golf balls are often hit over a very long distance and hence out of the player's visual range. Since as a rule several players play together, after such a shot it is no longer clear which golf ball belongs to which player, although this of decisive importance for the further course of the game.

Therefore, the object of this invention is to make available a golf ball stamping device and a method with which golf balls can be marked with an individual character identifying the player in question.

SUMMARY OF THE INVENTION

According to the invention, the object is achieved by means of a golf ball stamping device comprising a housing accommodating an ink pad a means with which a golf ball can be mounted in a manner that prevents it from turning, and a stamping means with which at least one character can be stamped onto the golf ball.

This device enables the individual character identifying the player in question to be printed on the golf ball and hence the golf ball to be assigned to the player in question.

According to the invention, the golf ball stamping device has a means with which the golf ball can be mounted in a manner that prevents it from turning so that it does not slip during the stamping and therefore the printing ink, for example printer's black, does not become smudged. Preferably, this means is a cylindrical or substantially square bore hole in which the golf ball sits.

Also according to the invention, the golf ball stamping device comprises a stamping means. This stamping means can be any kind of stamping means.

Preferably, the housing is divided into two, whereby one part of the housing accommodates the means with which the golf ball can be mounted in a manner that prevents it from turning and the other part of the housing accommodates the stamping means.

In a preferred embodiment of the invention, the two parts of the housing are connected to each other by means of a guide. This guide may be used to pull the two housing parts apart along a clearly defined axis and to push them together again.

Preferably, the two parts of the housing have compatible threads so that the two housing parts can particularly preferably be connected to each other in a gas-tight manner.

According to the invention, the golf ball stamping device comprises a stamping means. This stamping means can be any kind of stamping means with which one or preferably more characters can be printed on a golf ball. Preferably, the stamping means comprises several continuous bands on which a plurality of characters is arranged. The continuous bands can, for example, be adjusted by means of a small wheel so that numerous different characters or combinations of characters can be printed on the golf ball.

Preferably, holes are provided in the part of the housing in which the stamping means is accommodated through which the stamping means, particularly preferably the continuous bands, can be adjusted from the outside. Preferably, the adjustment is performed by means of small wheels. Arranged on the small wheels are characters corresponding to the characters to be printed on the golf ball so that the user can see the characters he is stamping on the golf ball from the outside.

Preferably, the stamping means is shaped so that it is adapted to the spherical shape of the golf ball. However, the stamping means can also be overall so flexible that it is adapted not only to the spherical shape of the golf ball, but also to its dimples.

Also preferably, a plate is spring-mounted in the part of the housing in which the stamping means is accommodated, said plate having a hole in the middle that is slightly larger than the stamping means. The plate is located between the stamping means and the golf ball. This plate firstly prevents the hand placing the golf ball between the two housing parts for stamping from being dirtied with the printing ink. Secondly, it also clamps the golf ball when the two housing parts are brought together shortly before the stamping means comes into contact with the golf ball thus preventing the golf ball from slipping during the stamping.

According to the invention, the golf ball stamping device comprises a reservoir for the printing ink, preferably an ink pad, which is preferably accommodated in the first housing part preferably facing the stamping means so that every time the two housing parts are pushed together, the stamping means is wetted with printing ink.

The golf ball stamping device according to the invention enables the individual characters identifying a golf player to be printed on a golf ball in a very simple manner. The golf ball stamping device is very compact and simple to make. The printing ink does not dry out.

A further object of the invention is a method for stamping golf balls using the above-described device, wherein a. the characters to be printed are set
b. the screw connection between the first and second housing parts is unscrewed and the two housing parts are pulled far enough apart from each other to enable a golf ball to be accommodated between the two housing parts and mounted in the first means in a manner that prevents it from turning,
c. the golf ball is placed between the two housing parts on the means that prevents it from turning,
d. the two housing parts are brought together along the guide until the stamping means is in contact with the golf ball,
e. the two housing parts are pulled far enough apart from each other along the guide to enable the golf ball to be removed again,
f. the golf ball is removed and
g. the two housing parts are brought together again and screwed together.

BRIEF DESCRIPTION OF THE DRAWINGS

In the drawing:

FIG. 1 is an elevational view of the golf ball stamping device according to the present invention;

FIG. 2 is a sectional view taken along sectional line B—B of FIG. 1;

FIG. 3 is a top view of the device of FIG. 1;

FIG. 4 is a bottom view of the device of FIG. 1; and

FIG. 5 is a sectional view taken along sectional line A—A of FIG. 2.

DETAILED DESCRIPTION OF THE INVENTION

FIG. 1 shows the golf ball stamping device according to the invention. The golf ball stamping device has a housing 7 divided into a first housing part 8 and a second housing part 9. The housing parts 8, 9 can be screwed together as indicated by the arrow. The two housing parts are connected to each other by the guide rail 10 and can be pulled apart or pushed together along this guide rail. The guide rail 10 is long enough to enable a golf ball 4 to be placed between the two housing parts 8, 9. The first housing part accommodates a disk 1 with an opening 11 which partially holds the golf ball 4. The golf ball 4 is mounted in this opening 11 in a manner that prevents it from turning. Above the golf ball, there is a stamping means 12 with which characters are stamped on the golf ball. In this example, the stamping means comprises four continuous bands 13 each of which can be turned separately from the others by means of a small wheel 14 so that a plurality of character combinations can be set on the stamp head 15. The small wheels also have characters (not shown), so that these characters can be used to determine which character combination is set on the print head 15 and hence printed on the golf ball. The small wheels are adjusted through the opening 17. The print head 15 is curved in two directions, whereby the radius of curvature substantially corresponds in each case to the radius of curvature of the golf ball. Accommodated between the print head 15 and the golf ball 4 is a plate 16 with two springs 18. When the two housing parts 8, 9 are pushed together the plate 16 is pressed against the golf ball and the springs 18 are then pushed together until the print head 15 lies firmly on the golf ball 4. Due to the fact that the springs 18 press the plate 16 downwards, the golf ball 4 is clamped before the stamping so that is unable to slip during the stamping.

Accommodated below the golf ball in the first housing part 8 is a printer's black tank 19.

The stamping process takes place as follows: the character to be printed is set with the small wheels 14. Then, the two housing parts 8, 9 are unscrewed from each other and pulled apart and the golf ball 4 placed in the opening 11. The two housing parts 8, 9 are then pushed together until the stamping means 15 lies firmly on the golf ball. Then the two housing parts are pulled apart again, the stamped golf ball removed and the two housing parts pushed together again and screwed together.

What is claimed is:

1. Golf ball stamping device comprising a housing (7) accommodating an ink pad (19)

a means (11) with which a golf ball (4) can be mounted in a manner that prevents the golf ball from turning, and a stamping means (12) with which at least one character can be stamped onto the golf ball (4), wherein the stamping means (12) comprises at least one continuous band (13) and a wheel (14) for turning the continuous band (13).

2. Golf ball stamping device according to claim 1, wherein the housing is divided into first and second housing parts (8, 9), wherein the means (11) is accommodated in the first housing part (8) and the stamping means (12) is accommodated in the second housing part (9).

3. Golf ball stamping device according to claim 2, wherein the first and second housing parts (8, 9) are connected to each other by a guide means (10).

4. Golf ball stamping device according to claim 2, wherein the first and second housing parts (8, 9) further comprise a screw connection by which the first and second housing parts (8, 9) can be screwed together.

5. Golf ball stamping device according to claim 4, wherein the screw connection is a gas-tight screw connection.

6. Golf ball stamping device according to claim 2, wherein the second housing part (9) has at least one, opening (17) through which the character on the stamping means can be set from the outside the stamping device.

7. Golf ball stamping device according to claim 6, wherein the second housing part (9) has two openings.

8. Golf ball stamping device according to claim 2, wherein accommodated in the second housing part (9) is a spring-mounted plate (16) with an opening (20) that is slightly larger than the stamping means, with which the golf ball (4) is clamped immediately before being printed.

9. Golf ball stamping device according to claim 2, wherein accommodated in the first housing part (8) is a reservoir (19) for printing ink.

10. Golf ball stamping device according to claim 1, wherein the surface (15) of the stamping means (12) is at least partially adapted to the surface of the golf ball.

11. A method for stamping golf balls using the device according to claim 4, comprising the steps of:

(a) setting the at least one character to be printed;

(b) unscrewing the screw connection between the first and second housing parts (8, 9), pulling the first and second housing parts far enough apart from each other along the guide means (10) to enable a golf ball to be accommodated between the first and second housing parts (8, 9) and placing the golf ball between the first and second housing parts (8, 9) in the means (11) in a manner that prevents the golf ball from turning;

(c) bringing the first and second housing parts (8, 9) together along guide means (10) until the stamping means (12) is in contact with the golf ball;

(d) pulling the first and second housing parts far enough apart from each other along the guide means (10) to enable the golf ball (4) to be removed;

(e) removing the golf ball, and (f) bringing the first and second housing parts together again and securing the first and second housing parts together by screwing the screw connection.

* * * * *